US005350314A

United States Patent [19]

Saba

[11] Patent Number: 5,350,314

[45] Date of Patent: Sep. 27, 1994

[54] ANTI-ROTATION CONNECTOR

[75] Inventor: Toshikazu Saba, Yokkaichi, Japan

[73] Assignee: Sumitomo Wiring Systems, Ltd., Yokkaichi, Japan

[21] Appl. No.: 28,190

[22] Filed: Mar. 9, 1993

[30] Foreign Application Priority Data

Apr. 16, 1992 [JP] Japan ..... 4-024403[U]

[51] Int. Cl.[5] ..... H01R 13/62

[52] U.S. Cl. ..... 439/378; 123/470

[58] Field of Search ..... 439/376, 378, 379, 296–298; 123/470

[56] References Cited

U.S. PATENT DOCUMENTS 5,140,963 8/1992 Brackett et al. ..... 123/470

*Primary Examiner*—Eugene F. Desmond

*Attorney, Agent, or Firm*—Sandler, Greenblum & Bernstein

[57] ABSTRACT

An anti-rotation connector which is so arranged that a guide member is provided on a connector, while a rib portion for engagement with the guide member is formed on a delivery pipe to which an injector is attached, so that by engaging the guide member with the rib portion, the injector and the connector are held in regular positions. The guide member is slidably mounted on the connector, and after fitting the connector with the injector, the injector is rotated, and the thereafter, the guide member is caused to slide for engagement with the rib portion.

5 Claims, 5 Drawing Sheets

ANTI-ROTATION CONNECTOR

BACKGROUND OF THE INVENTION

1. Field of the Invention

The present invention generally relates to a connector and more particularly, to an anti-rotation connector which is arranged to be fitted with an injector so as to maintain the injector and the connector itself at regular positions, thereby to prevent rotation thereof.

2. Description of the Prior Art

Conventionally, as shown in FIGS. 8 to 10, it has been a general practice that a connector 3 is fitted with an injector 2 inserted in a delivery pipe 1 installed in an engine room, and tabs 4 provided to project within the injector 2 are connected with wire pressure-contact terminals 5.

In the known arrangement as described above, however, since the injector 2 is merely inserted in the delivery pipe 1, it tends to be rotated or pivoted in directions as indicated by arrows in FIG. 10, and accordingly, there is such a disadvantage that when the connector 3 is rotated by being pulled through an electric wire W or by vibrations, the injector 2 fitted therewith is also rotated.

SUMMARY OF THE INVENTION

Accordingly, an essential object of the present invention is to provide an anti-rotation connector which is arranged to prevent rotation of an injector mounted on a delivery pipe through employment of the connector fitted with the injector, and also to improve workability for fitting of said connector.

Another object of the present invention is to provide an anti-rotation connector of the above described type in which the injector is returned to a regular position through fitting thereof with the connector, and the injector and connector are held in position at said regular position.

A further object of the present invention is to provide an anti-rotation connector of the above described type which is simple in construction and stable in functioning at high reliability, and can be readily manufactured at low cost.

In accomplishing these and other objects, according to one preferred embodiment of the present invention, there is provided an anti-rotation connector arranged to be fitted with a mating fitting member rotatably mounted with respect to a fixing member. The anti-rotation connector includes a guide member provided thereon, and a rib portion formed to project outwardly from the fixing member connected with the mating fitting member. The mating fitting member and the connector are adapted to be held in a regular position by engaging the guide member with the rib portion.

The guide member provided on the connector has a pair of guide pieces opposed to each other through a predetermined interval, and adapted to receive said rib portion therebetween so as to prevent displacement of the guide pieces by the rib portion.

It is preferable that said guide member is slidably engaged with a guide groove means formed on the upper surface of a connector housing, and through rotation after fitting the connector with the mating fitting member, the guide member is caused to slide for engagement with said rib portion.

As described above, by engaging the guide member of the connector with the rib portion, the connector may be positioned at the regular position, and thus, the mating fitting member such as the injector or the like which is fitted with said connector can also be positioned at the regular position, and thus, it becomes possible to stop rotation of the mating fitting member such as the injector and the connector.

Furthermore, in the case where the above guide member is arranged to be movable by sliding, even if a sufficient space is not available in an engine room, etc. and fitting of the connector is not readily effected by the protruding guide member, it may be so processed that the guide member is first fitted with the injector at the retreated position, and thereafter, the guide member is slid and engaged with the rib portion for improvement of workability.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
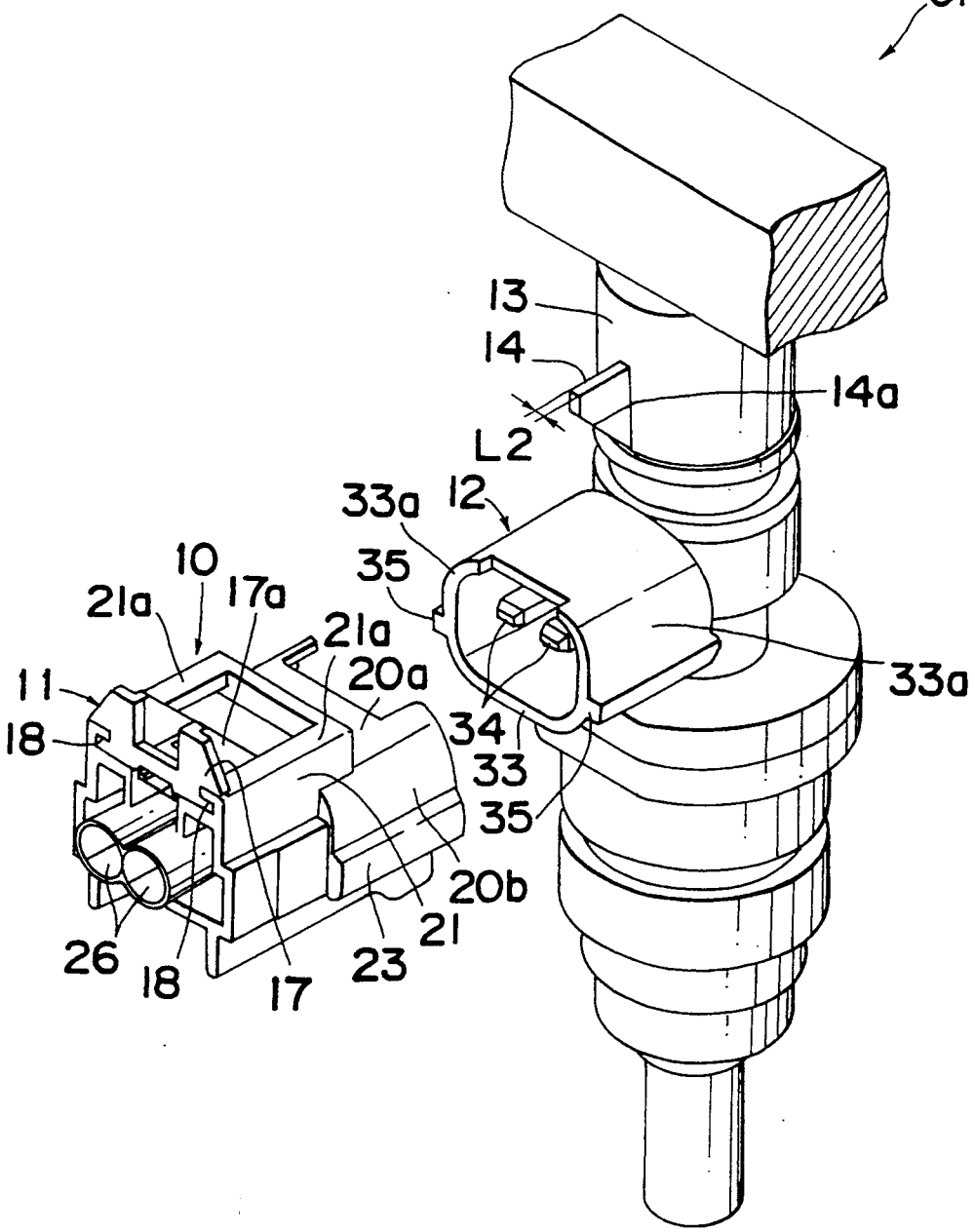
FIG. 1 is a perspective view showing an anti-rotation connector according to a first embodiment of the present invention.

Before the description of the present invention proceeds, it is to be noted that like parts are designated by like reference numerals throughout the accompanying drawings.

Referring now to the drawings, there is shown in FIGS. 1 to 6, an anti-rotation connector C1 for an injector according to one preferred embodiment of the present invention, which generally includes a guide member 11 slidably mounted on the connector 10, and a rib portion 14 formed to project outwardly from a fixing member e.g., a delivery pipe 13 connected with a mating fitting member, e.g., an injector 12 for engagement with the guide member 11. The injector 12 and the connector 10 are held in regular position by engaging said guide member 11 with the rib portion 14.

Figure 2:
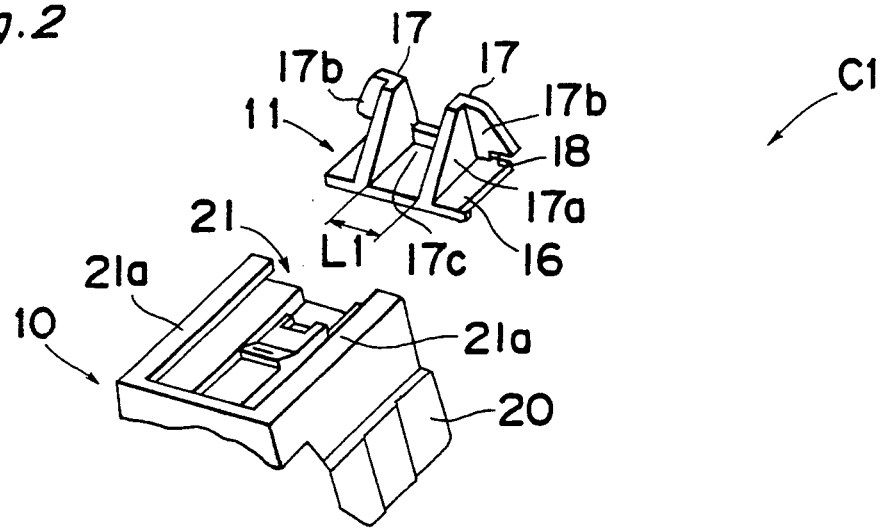
FIG. 2 is a fragmentary exploded perspective view showing a guide member and a mounting portion for said guide member in the arrangement of FIG. 1.
Figure 3:
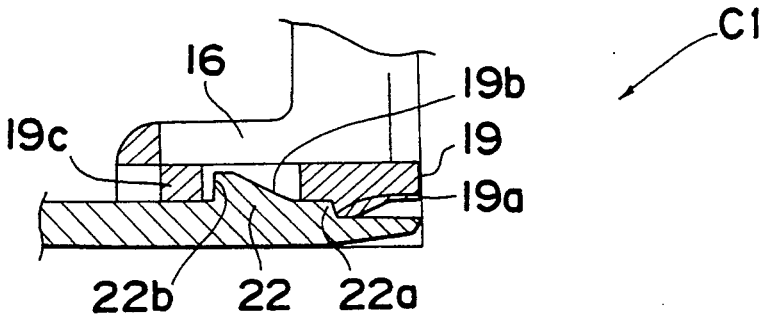
FIG. 3 is a fragmentary cross sectional view, on an enlarged scale, at an engaging portion between the guide member and the connector in the arrangement of FIG. 1, FIGS. 4, 5 and 6 are cross sectional diagrams for explaning fixing of the connector with the injector.

The guide member 11 further includes a flat platelike base 16, and a pair of left and right guide pieces 17 provided to extend upwardly from the upper surface of the base 16 through a predetermined interval L1 provided between the guide pieces 17 (FIG. 2). Each of the guide pieces 17 has a confronting side face 17*a* formed into a tapered shape, and a forward edge face 17*b* folded outwardly from a forward edge of said side face 17*a*, with a guide groove 18 being formed between a lower edge of said forward edge face 17*b* and the surface of the base 16. The space between said confronting side faces 17*a* is set to be a rib inserting portion 17*c* (FIG. 2). Moreover, as shown in FIG. 3, a stopper portion 19 is formed on the under face of the base 16 for engagement with the connector. The stopper portion 19 is provided with a protrusion 19*a* projecting in a V-shape towards the side of the forward edge face 17*b*, while a corresponding stopper hole 19*b* is formed with respect to said protrusion 19*a* so as to form a shape with a projection 19*c*.

Meanwhile, in the connector 10, on an outer face 20*a* of the upper wall of the housing 20, a guide portion 21 is provided for slidably engaging said guide member 11 in a longitudinal direction from a central portion towards the forward end remote from the injector fitting side.

The guide portion 21 has guide walls 21*a* each having an L-shaped cross section and extending upwardly from opposite left and right side portions thereof. Between said guide walls 21, the base 16 of the guide member 11 is inserted, with the upper portion of the guide walls 21*a* being fitted in guide grooves 18, so that the guide member 11 can be slid from the rear edge position remote from the injector fitting side, up to the forward edge position at a central portion of the connector.

At the rear end position confronting the under face of the base 16 between the guide walls 21*a*, a guide stopper portion 22 is provided as shown in FIG. 3. The guide stopper portion 22 has an inclined protrusion 22*a* for a temporary stopping to be engaged with the above protrusion 19*a*, and also, another protrusion 22*b* for a full stopping also inclined at the rear edge side thereof to be inserted into the stopper hole 19*b* so as to engage the forward edge face of said protrusion 22*b* with the rear edge face of the protrusion 19*c* (FIG. 3).

Figure 4:
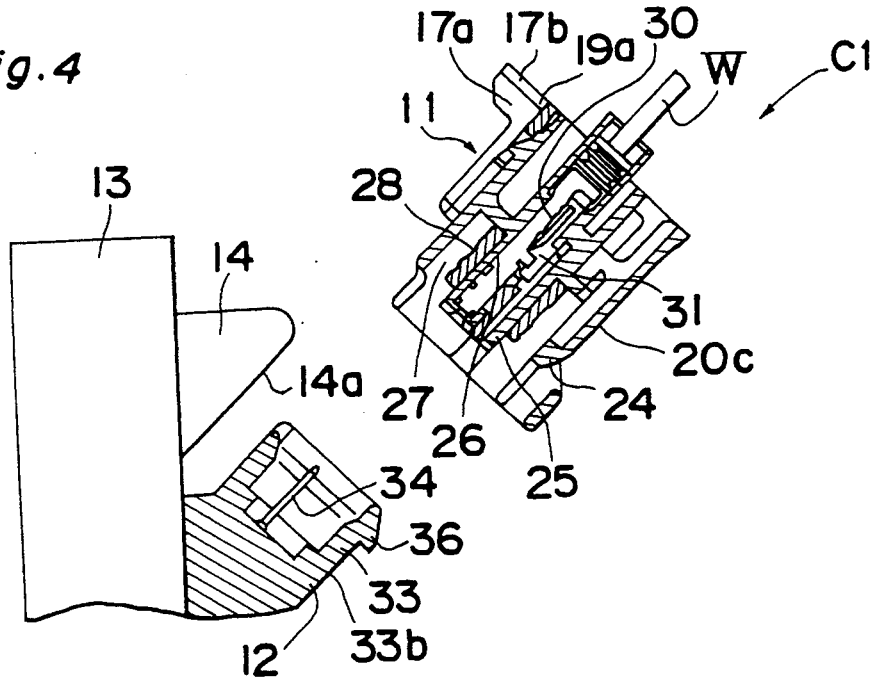

On the left and right side outer walls 20*b* of the above connector 10, guide recess portions 23 are formed at the injector fitting side, while an engaging piece 24 is formed on a lower wall 20*c* (FIG. 4).

Inside the connector housing 20, terminal accommodating chambers 26 are formed through partition wall 25, while an injector housing insertion recess 27 is provided between said partition wall and the outer wall. Moreover, in the injector housing insertion recess 27, a presser piece 28 formed with concave and convex portions on its surface is provided so as to press the injector housing to be inserted, against the inner face of the outer wall.

In the terminal accommodating chambers 26 of the connector 10, terminals 30 fixed under pressure to the forward ends of a wire W are inserted, and a lance portion 31 formed on the connector 10 engages the terminal 30 to hold them in a regular position.

The injector 12 to be fitted with the connector 10 is attached by merely inserting the base end side thereof into a fixing hole (not shown) of the delivery pipe 13, and therefore, the injector 12 is not held by positioning with respect to the delivery pipe 13 so as to be in a state readily to be rotated. Moreover, although not shown, an engine block is installed at a lower position with respect to the injector 12, while pipes and the like are disposed in an upper position, and thus, a space for mounting the connector 10 to the injector 12 is limited to be extremely narrow.

On the delivery pipe 13 on which the injector 12 is mounted, a rib portion 14 is formed in a position above the injector mounted portion. The rib portion 14 has a width L2 smaller than the width L1 between the side face portions 17*a* of the guide pieces 17 of the guide member 11 as referred to earlier, thereby to allow the rib portion 14 to be inserted into the rib inserting portion 17*c*. Furthermore, the under surface 14*a* of the rib portion 14 is tapered for easy insertion into said rib inserting portion 17*c*.

The rib portion 14 is provided in such a position that, when a center in a lateral direction of the injector 12 is positioned on the same vertical axis line as that of said rib portion 14, said position becomes the regular mounting position of the injector.

Within the housing 33 of said injector 12, tabs 34 are formed, while guide pieces 35 to be fitted in the guide concave portions 23 of the connector 10 are formed on the left and right side walls 33*a* of the housing 33, and also, a stopper piece 36 which engages the engaging piece 24 of the connector 10 is provided at the forward edge side of the lower wall 33*b*.

By the above arrangement, when the connector 10 is to be attached to the injector 12, the guide member 11 is first temporarily stopped at the rear edge position remote from the injector fitting side of the connector 10 as shown in FIG. 4. In this temporary stopping position, the protrusion 22*b* of the guide stopper portion 22 is engaged with the stopper hole 19*b* of the guide member 11, and holds said guide member 11 in the temporary stopping position.

Figure 5:
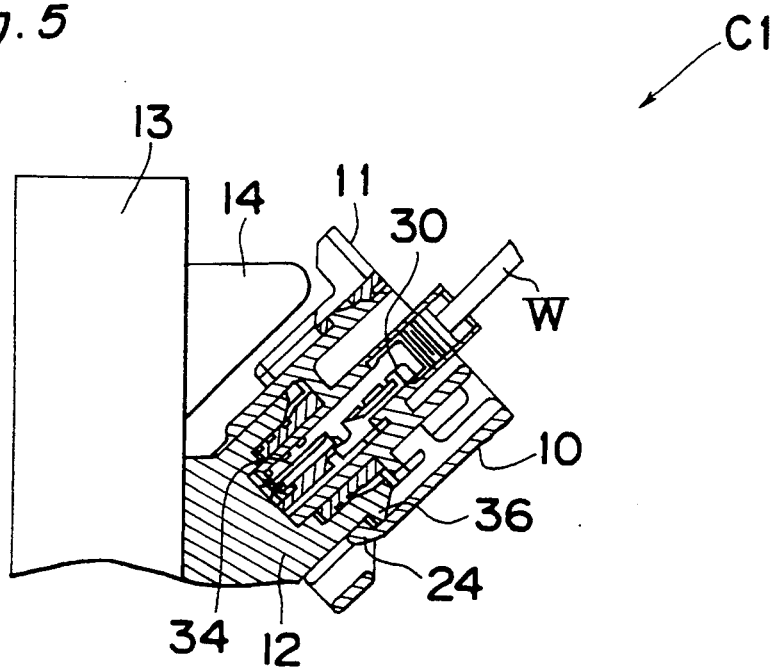

In the state where the guide member 11 is retained in the temporary stopping position, the connector 10 is attached to the injector 12. In this case, the guide concave portions 23 of the connector 10 are fitted with the guide pieces 35 of the injector housing 33, and thus, said injector housing 33 is inserted into the injector housing inserting recess 27. As shown in FIG. 5, in the state where the connector 10 is mounted on the injector 12, the tabs 34 are connected to the terminals 30 accommodated in the terminal accommodating chambers 26. Meanwhile, the stopper piece 36 of the injector 12 and the engaging piece 24 of the connector 10 are locked, whereby the connector 10 is held by the injector 12.

Figure 6:
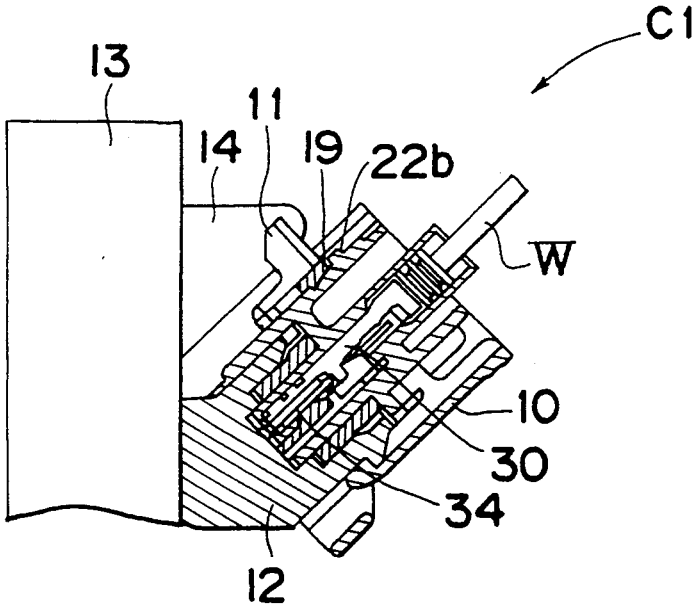

After the connector 10 has been mounted on the injector 12, the guide member 11 is advanced for engagement with the rib portion 14. In this case, if the injector 12 has been turned to a position deviated from a regular position, 10 said injector 12 is rotated up to the regular position. Thereafter, upon pushing the guide member 11 forwardly, the protrusion 19*a* rides over the protrusion 22*a* to advance out of the temporary stopping position, and the rib portion 14 is inserted into the rib inserting portion 17*c*. As shown in FIG. 6, at the forward edge position, the guide member 11 is formally stopped, with the rear edge of the stopper portion 19 engaged with the protrusion 22*a*.

As described above, by holding the rib portion 14 between the guide pieces 17, the connector 10 is held in the regular position, and the injector 12 fitted with said connector 10 is also maintained in the regular position.

Figure 7:
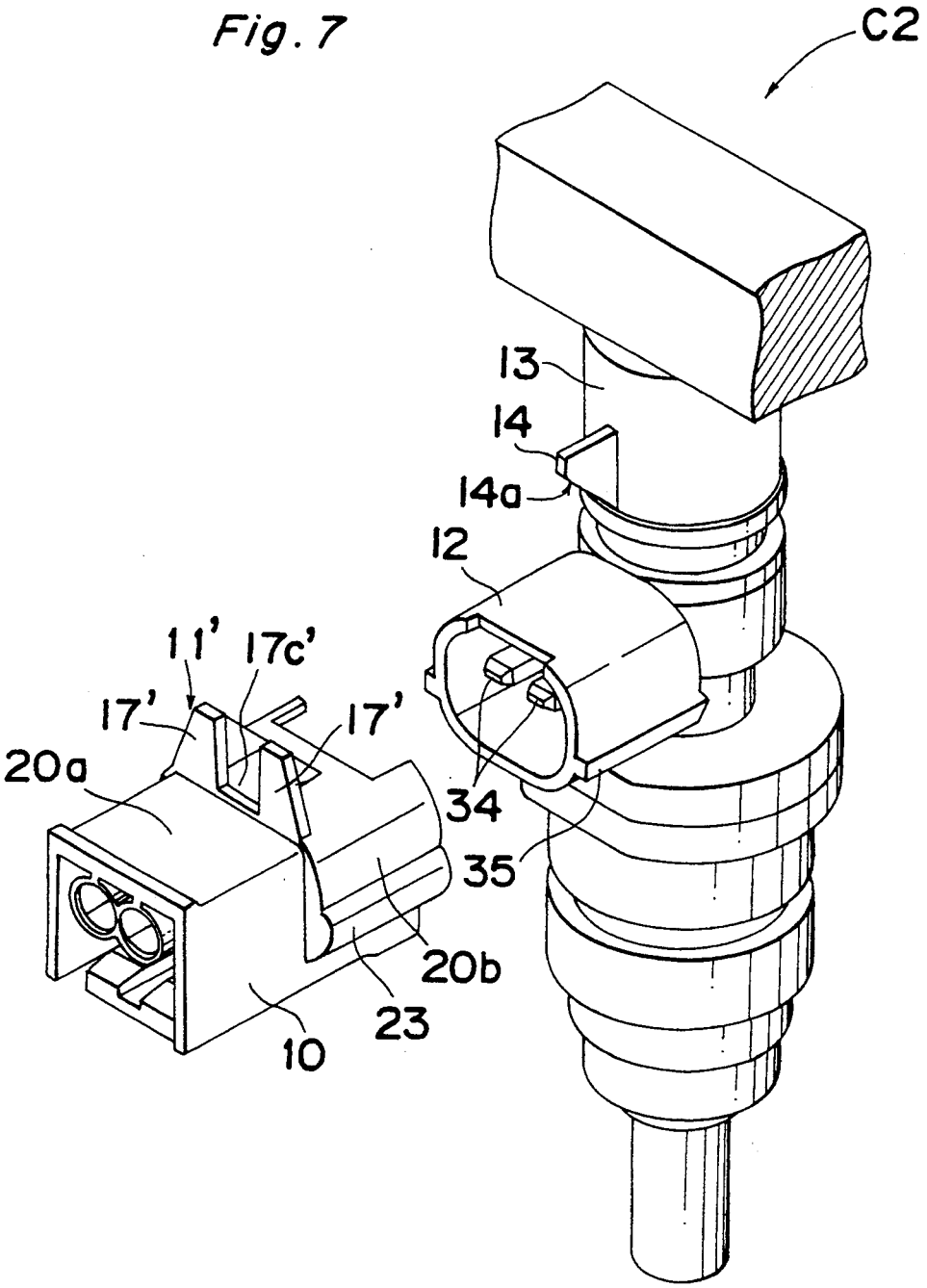
FIG. 7 is a perspective view similar to FIG. 1, which particularly relates to a second embodiment of the present invention.
Figure 8:
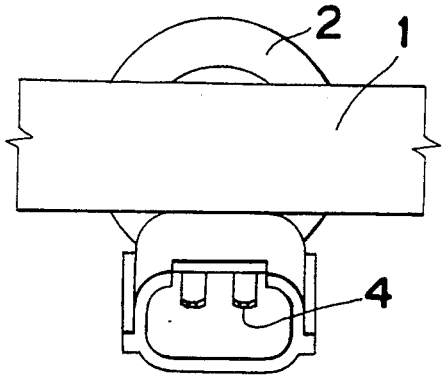
Fig.8 PRIOR ART
FIG. 8 is a fragmentary top plan view showing the injector attached to a delivery pipe in a conventional arrangement (already referred to)
Figure 9:
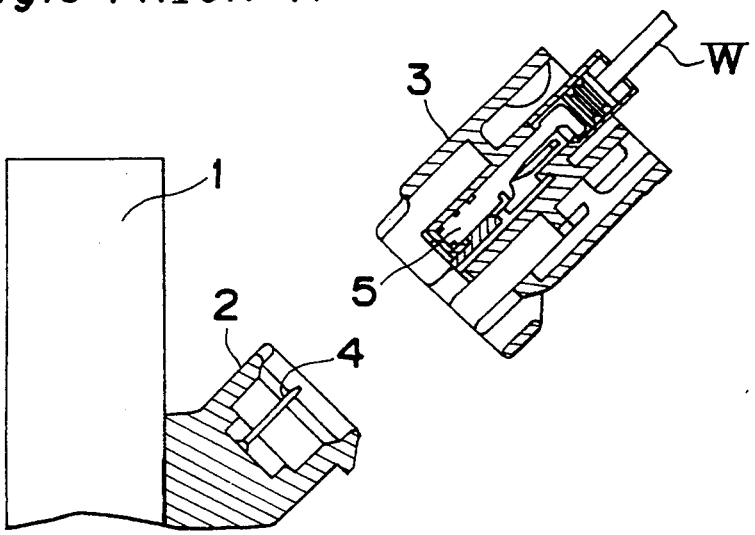
Fig.9 PRIOR ART
FIG. 9 is a view similar to FIG. 4, which particularly relates to the conventional arrangement (already referred to)
Figure 10:
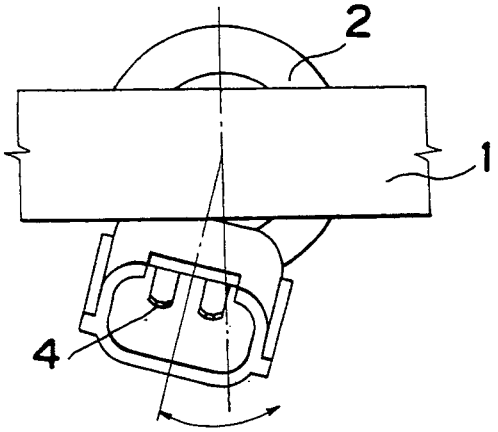
Fig.10 PRIOR ART
FIG. 10 is a view similar to FIG. 8, which particularly shows a problem encountered in the conventional arrangement.

Referring to FIG. 7, there is shown an anti-rotation connector C2 according to a second embodiment of the present invention, in which the guide member 11 described as slidably mounted on the connector 10 in the anti-rotation connector C1 of the first embodiment in FIG. 1 has been replaced by a guide portion 11′ integrally formed generally at the central portion of the upper wall 20*a* of the connector 10, and also, having a pair of left and right guide pieces 17′, with the rib inserting portion 17*c*′ formed therebetween.

Since other construction and function of the anti-rotation connector C2 of the second embodiment in FIG. 7 are generally similar to those of the connector C1 in FIG. 1, detailed description thereof is abbreviated here for brevity of explanation, with like parts being designated by like reference numerals.

In the connector C2 of FIG. 7, for mounting the connector 10 on the injector 12, said injector 12 is first positioned at the regular position in the state where the injector fitting side of the connector 10 is fitted with the injector 12 to a slight degree, and the rib portion 14 is inserted between the guide pieces 17′.

In the above second embodiment of FIG. 7 also, the connector 10 is held in the regular position by the engagement between the guide portion 11′ and the rib portion 14, and the injector 12 fitted with the connector 10 is also held in the regular position.

It is to be noted here that the concept of the present invention is not limited in its application to the anti-rotation connector for the injector alone, but may be favorably applied to any connector to be fitted with the mating fitting member (mating connector) rotatably mounted with respect to the fixing member as in the injector.

As is clear from the foregoing description, since the anti-rotation connector according to the present invention is provided with the guide member or guide portion, with said guide member arranged to be engaged With the rib portion provided on the delivery pipe, the injector and the connector can be advantageously held in the regular position.

Particularly, when the guide member is slidably mounted on the connector as in the first embodiment, the guide member and the rib portion are stopped at the regular position through rotation of the injector after fitting the connector to the injector, and therefore, the connector can be fitted irrespective of the positions of the injector. As in the above arrangement, the fact that the fitting direction of the connector is not specified is very effective in the kind of vehicles having only a small space within the engine compartment, thus improving workability in the fitting of connectors to a large extent.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An anti-rotation connector arranged to be fitted with a mating fitting member rotatably mounted with respect to a fixing member, said anti-rotation connector comprising a guide member provided thereon, and a rib portion formed to project outwardly from said fixing member connected with said mating fitting member, said guide member being movable with respect to said connector toward and away from said rib portion, said mating fitting member and said connector being adapted to be held in a regular position by engaging said guide member with said rib portion.

2. An anti-rotation connector as claimed in claim 1, wherein said mating fitting member is an injector rotatably inserted into a delivery pipe as said fixing member, said rib portion being formed on said delivery pipe, said guide member provided on the connector having a pair of guide pieces opposed to each other through a predetermined interval, and adapted to receive said rib portion therebetween.

3. An anti-rotation connector as claimed in claim 1, wherein said guide member is slidably engaged with a guide groove means formed on the upper surface of a connector housing, and is arranged to be engaged with said rib portion by being advanced from a rear end position in a longitudinal direction of said connector.

4. An anti-rotation connector arranged to be fitted with a mating fitting member rotatably mounted with respect to a fixing member, said anti-rotation connector comprising a guide member provided thereon, and a rib portion formed to project outwardly from said fixing member connected with said mating fitting member, and said connector being adapted to be held in a regular position by engaging said guide member with said rib portion, wherein said guide member is slidably engaged with a guide groove means formed on the upper surface of a connector housing, and is arranged to be engaged with said rib portion by being advanced from a rear end position in a longitudinal direction of said connector.

5. An anti-rotation connector as claimed in claim 4, wherein said mating fitting member is an injector rotatably inserted into a delivery pipe as said fixing member, said rib portion being formed on said delivery pipe, said guide member provided on the connector having a pair of guide pieces opposed to each other through a predetermined interval, and adapted to receive said rib portion therebetween.

* * * * *

UNITED STATES PATENT AND TRADEMARK OFFICE

CERTIFICATE OF CORRECTION

PATENT NO. : 5,350,314

DATED : September 27,1994

INVENTOR(S) : Toshikazu SABA it is certified that error appears in the above-indentified patent and that said Letters Patent is hereby corrected as shown below:

On the title page item [57], line 9, change "and the" to ---and---.

Column 2, line 34, change "explaning" to --- explaining---.

Column 5, line 35, change "With" to ---with---.

Signed and Sealed this

Sixteenth Day of May, 1995

*Attest:*

*Attesting Officer*

Bruce Lehman

BRUCE LEHMAN

*Commissioner of Patents and Trademarks*